US008538289B2

(12) United States Patent
Kubo et al.

(10) Patent No.: US 8,538,289 B2
(45) Date of Patent: Sep. 17, 2013

(54) DEVELOPING DEVICE AND IMAGE FORMING APPARATUS

(75) Inventors: Keisuke Kubo, Kanagawa (JP); Takeshi Okoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

(21) Appl. No.: 13/117,616

(22) Filed: May 27, 2011

(65) Prior Publication Data

US 2012/0114394 A1 May 10, 2012

(30) Foreign Application Priority Data

Nov. 9, 2010 (JP) ..... 2010-250783

(51) Int. Cl.
*G03G 15/08* (2006.01)

(52) U.S. Cl.
USPC ..... 399/102; 399/284

(58) Field of Classification Search
USPC ..... 399/102, 104, 105, 284
See application file for complete search history.

(56) References Cited

U.S. PATENT DOCUMENTS

2006/0263111 A1 11/2006 Hamakawa et al.

FOREIGN PATENT DOCUMENTS

JP 2006-284889 A 10/2006
JP 2006-284896 A 10/2006
JP 2008-164942 A 7/2008

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

A developing device includes a developer transport body that transports developer to develop an electrostatic latent image on an image carrier, a housing that holds the developer transport body and defines an exposed portion and an unexposed portion, the housing including a storage portion storing the developer, and a layer-thickness regulation member that regulates a layer thickness of the developer transported to the exposed portion and includes one side close to a surface of the developer transport body, a first portion, and a second portion. The housing includes first faces that define both ends of the storage portion in the rotation axis direction of the developer transport body, a second face, and a third face. The developing device further includes a closing member that closes a gap between the layer-thickness regulation member and the second and third faces, and a magnet provided between the second and third faces.

4 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2010-250783 filed Nov. 9, 2010.

BACKGROUND (i) Technical Field

The present invention relates to a developing device and an image forming apparatus.

(ii) Related Art

There are known developing devices each including a developing roller that opposes an image carrier on which an electrostatic latent image is formed and that transports developer while rotating to develop the electrostatic latent image.

SUMMARY

According to an aspect of the present invention, there is provided a developing device including a cylindrical developer transport body that opposes an image carrier on which an electrostatic latent image is formed and that transports developer while rotating to develop the electrostatic latent image, a housing that holds the developer transport body and that defines an exposed portion exposed outside on a side of the developer transport body close to the image carrier and an unexposed portion, the housing including, on a side of the unexposed portion, a storage portion that stores the developer such that the developer is in contact with the developer transport body, and a layer-thickness regulation member that defines the storage portion and regulates a layer thickness of the developer transported to the exposed portion by rotation of the developer transport body, the layer-thickness regulation member including one side extending in a rotation axis direction of the developer transport body and provided close to a surface of the developer transport body at a boundary where the surface of the developer transport body shifts from the unexposed portion to the exposed portion during rotation, a first portion extending from the side in a direction intersecting the surface, and a second portion extending from the first portion toward the unexposed portion. The housing includes first faces that face from both ends in the rotation axis direction of the developer transport body toward the center in the rotation axis direction on the side of the unexposed portion and that define both ends of the storage portion in the rotation axis direction, a second face that faces the first portion of the layer-thickness regulation member on the side of the unexposed portion and on an outer side of the storage portion, and a third face that faces the second portion of the layer-thickness regulation member on the side of the unexposed portion and on the outer side of the storage portion. The developing device further includes a closing member that closes a gap between the layer-thickness regulation member and the second face and the third face of the housing, and a magnet that opposes a boundary between the first portion and the second portion of the layer-thickness regulation member and is provided between the second face and the third face of the housing.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below with reference to the drawings.

Figure 1:
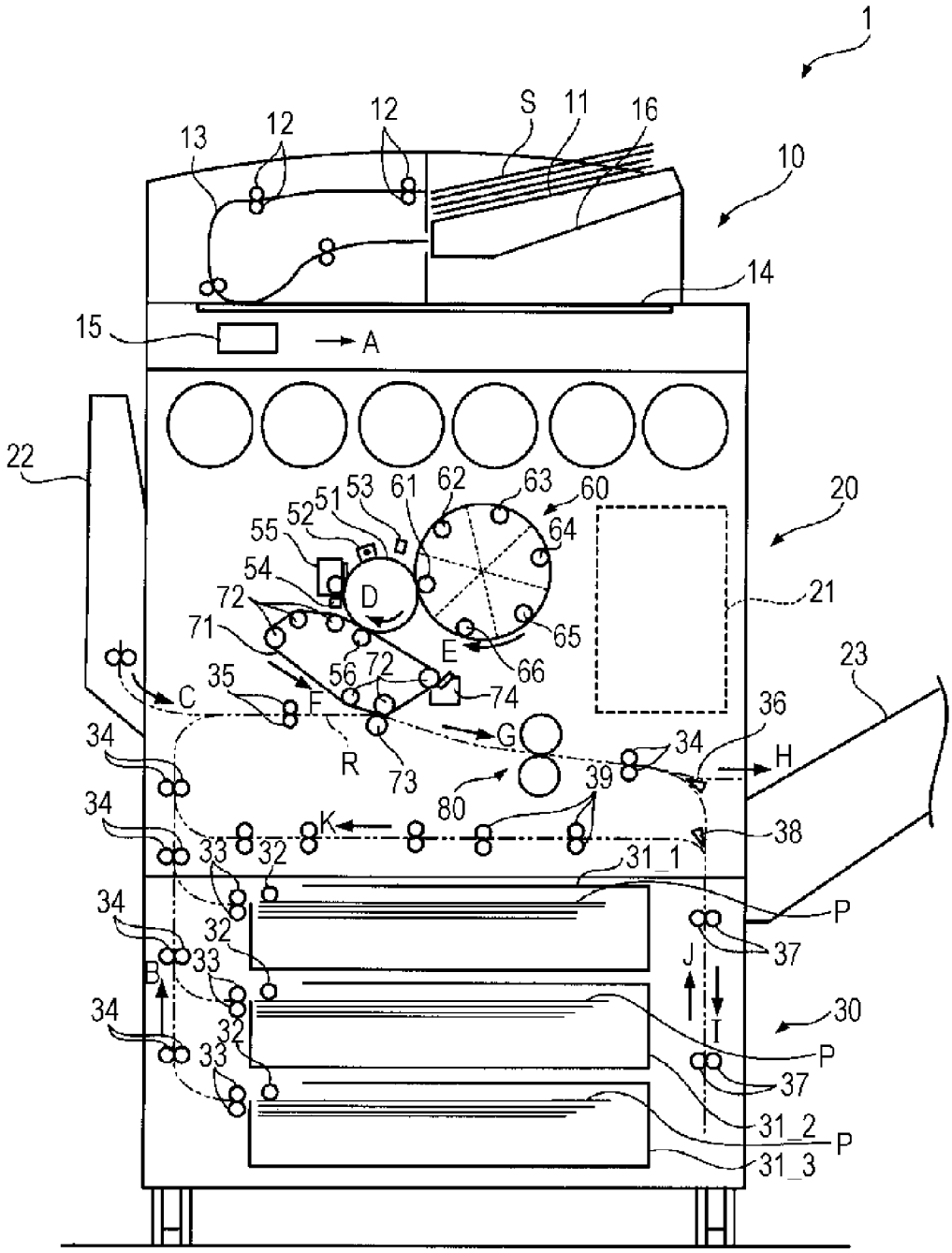
FIG. 1 is a schematic structural view of an exemplary embodiment of the present invention.

FIG. 1 is a schematic structural view of an image forming apparatus 1 according to an exemplary embodiment of the present invention. In the image forming apparatus 1 illustrated in FIG. 1, a developing device of the exemplary embodiment is incorporated.

The image forming apparatus 1 includes a document reading section 10, an image forming section 20, and a sheet storage section 30.

The document reading section 10 includes a document feeding table 11 on which documents S are stacked. The documents S stacked on the document feeding table 11 are fed out one by one, and are transported in a transport path 13 by transport rollers 12. Characters and images recorded on each transported document S are read by a document reading optical system 15 provided below a document reading plate 14 formed of transparent glass, and the document S is then output onto a document output table 16.

The document reading section 10 also includes a hinge extending in the right-left direction on the rear side thereof. On the hinge, the document feeding table 11 and the document output table 16 are turned up together. Below the turned document feeding table 11 and document output table 16, the document reading plate 14 is provided. In the document reading section 10, a document may be placed upside down on the document reading plate 14, instead of being placed on the document feeding table 11. In this case, the document reading optical system 15 moves in the direction of arrow A so as to read characters and images from the document placed on the document reading plate 14.

Image signals obtained by the document reading optical system 15 are input to a processing and control circuit 21. The processing and control circuit 21 controls the operations of the parts of the image forming apparatus 1 so as to form an image based on the input image signals.

The sheet storage section 30 provided in the lower part of the image forming apparatus 1 includes three sheet supply containers 31_1, 31_2, and 31_3, for example, in which sheets P having different sizes are stacked. The sheet supply containers 31_1, 31_2, and 31_3 are drawn when sheets P are supplied therein.

For example, from a sheet supply container that stores sheets P having a size corresponding to the size of the document (e.g., the sheet supply container 31_3), of these sheet supply containers 31_1, 31_2, and 31_3, the sheets P are fed out by a pickup roller 32, and are separated one by one by loosening rollers 33. Each one separated sheet P is transported upward by transport rollers 34 in the direction of arrow B, and is further transported after the timing of transportation downstream of standby rollers 35 is adjusted by the standby rollers 35. The transportation downstream of the standby rollers 35 will be described below.

The image forming section 20 includes a manual feed tray 22 that is turned open and close on a lower end thereof. The image forming section 20 also has a function of feeding a sheet placed on the opened manual feed tray 22 in the direction of arrow C.

A photoconductor 51 that rotates in the direction of arrow D is provided in the center of the image forming section 20. Around the photoconductor 51, a charging unit 52, an exposure unit 53, a developing device 60, a charge eliminating unit 54, and a cleaner 55 are arranged. Also, a transfer unit 56 is provided around the photoconductor 51 with a below-described intermediate transfer belt 71 being disposed therebetween.

The photoconductor 51 is roll-shaped. Charges are held on a surface of the photoconductor 51 by charging and are eliminated by exposure, so that an electrostatic latent image is formed on the surface. This photoconductor 51 corresponds to an example of an image carrier in the invention.

The charging unit 52 charges the surface of the photoconductor 51 at a certain charging potential.

The exposure unit 53 receives image signals from the processing and control circuit 21, and outputs exposure light modulated according to the input image signals. After being charged by the charging unit 52, the photoconductor 51 is irradiated with the exposure light from the exposure unit 53, and an electrostatic latent image is formed on the surface of the photoconductor 51. The electrostatic latent image formed on the surface of the photoconductor 51 by irradiation with the exposure light is then developed by the developing device 60, thereby forming a toner image on the surface of the photoconductor 51. The developing device 60 includes six developing units 61, 62, 63, 64, 65, and 66. The developing device 60 is a so-called rotary developing device that rotates in the direction of arrow E so as to move any one of the six developing units 61 to 66 (the developing unit 61 in a state of FIG. 1) to a position opposing the photoconductor 51. The electrostatic latent image formed on the photoconductor 51 is developed by the developing unit opposing the photoconductor 51 (developing unit 61 in this case) to form a toner image. The developing device 60 corresponds to an example of a developing device of the invention. Each of the six developing units 61, 62, 63, 64, 65, and 66 corresponds to an example of a developing unit of the present invention.

The six developing units 61 to 66 provided in the developing device 60 store toners of yellow (Y), magenta (M), cyan (C), black (K) and two other specific colors corresponding to the user applications. Examples of specific colors corresponding to the user applications are transparent toner used for image glazing and toner adjusted to a color frequently used by the user. To develop the electrostatic latent image on the photoconductor 51, the developing unit that stores the color toner to be currently used is rotated to the position opposing the photoconductor 51, and develops the electrostatic latent image with the color toner stored in the developing unit.

The toner images formed on the photoconductor 51 by development with the developing units are transferred onto the intermediate transfer belt 71 by the action of the transfer unit 56.

After transfer, the charges on the photoconductor 51 are eliminated by the charge eliminating unit 54, and residual toner on the photoconductor 51 are then removed by the cleaner 55.

The intermediate transfer belt 71 is an endless belt stretched around plural rollers 72, and circulates in the direction of arrow F. A transfer unit 73 is located near the intermediate transfer belt 71 with a sheet transport path R being disposed therebetween. Downstream of the transfer unit 73 in the circulating direction of the intermediate transfer belt 71, a cleaner 74 is provided to remove toner remaining on the intermediate transfer belt 71 after transfer with the transfer unit 73. The transfer unit 73 and the cleaner 74 are movable into contact with and away from the intermediate transfer belt 71. When forming a multicolor image, the transfer unit 73 and the cleaner 74 are separated from the intermediate transfer belt 71. In this state, a process of forming a toner image of one certain color on the photoconductor 51 and transferring the toner image onto the intermediate transfer belt 71 is repeated for the plural developing units (plural color toners) while rotating the developing device 60, whereby plural toner images of plural colors are sequentially transferred and superimposed on the intermediate transfer belt 71 to form a multicolor image.

After that, the transfer unit 73 is brought into contact with the intermediate transfer belt 71, and a sheet P is fed from the standby rollers 35 so that the sheet P reaches a transfer position, where the transfer unit 73 is located, at a time when the multicolor toner image reaches the transfer position. At the transfer position, the multicolor toner image is transferred from the intermediate transfer belt 71 onto the sheet P by the action of the transfer unit 73. Here, a combination of the transfer unit 56, the intermediate transfer belt 71, and the transfer unit 73 corresponds to an example of a transfer unit of the present invention. The sheet P on which the toner image is transferred is further transported in the direction of arrow G, and is heated and pressurized by a fixing unit 80, so that a fixed toner image is formed on the sheet P. The fixing unit 80 corresponds to an example of a fixing unit of the present invention. The sheet P passing through the fixing unit 80 is further transported by transport rollers 34 in the direction of arrow H, and is output onto a sheet output tray 23.

The cleaner 74 also moves into contact with the intermediate transfer belt 71, and removes toner remaining on the intermediate transfer belt 71 after transfer with the transfer unit 73.

The image forming apparatus 1 may form images on both surfaces of a sheet P. To form images on both surfaces of the sheet P, a sheet P having an image only on a first surface, as described above, is transported by transport rollers 37 in the direction of arrow I by switching a guide member 36, instead of being output to the sheet output tray 23. After that, the transport direction of the sheet P is reversed by the reverse rotation of the transport rollers 37, and the sheet P is transported in the direction of arrow J. Then, the sheet P is guided by another guide member 38 and is transported by transport rollers 39 in the direction of arrow K.

After that, an image is formed on a second surface of the sheet P, in a manner similar to the above. The sheet P having the images on both surfaces is then output onto the sheet output tray 23.

Next, a detailed description will be given of the six developing units 61, 62, 63, 64, 65, and 66 provided in the image forming apparatus 1 illustrated in FIG. 1. Since the developing units 61, 62, 63, 64, 65, and 66 have similar structures, the developing unit 61 opposing the photoconductor 51 in the state of FIG. 1 will be described on behalf of these developing units.

Figure 2:
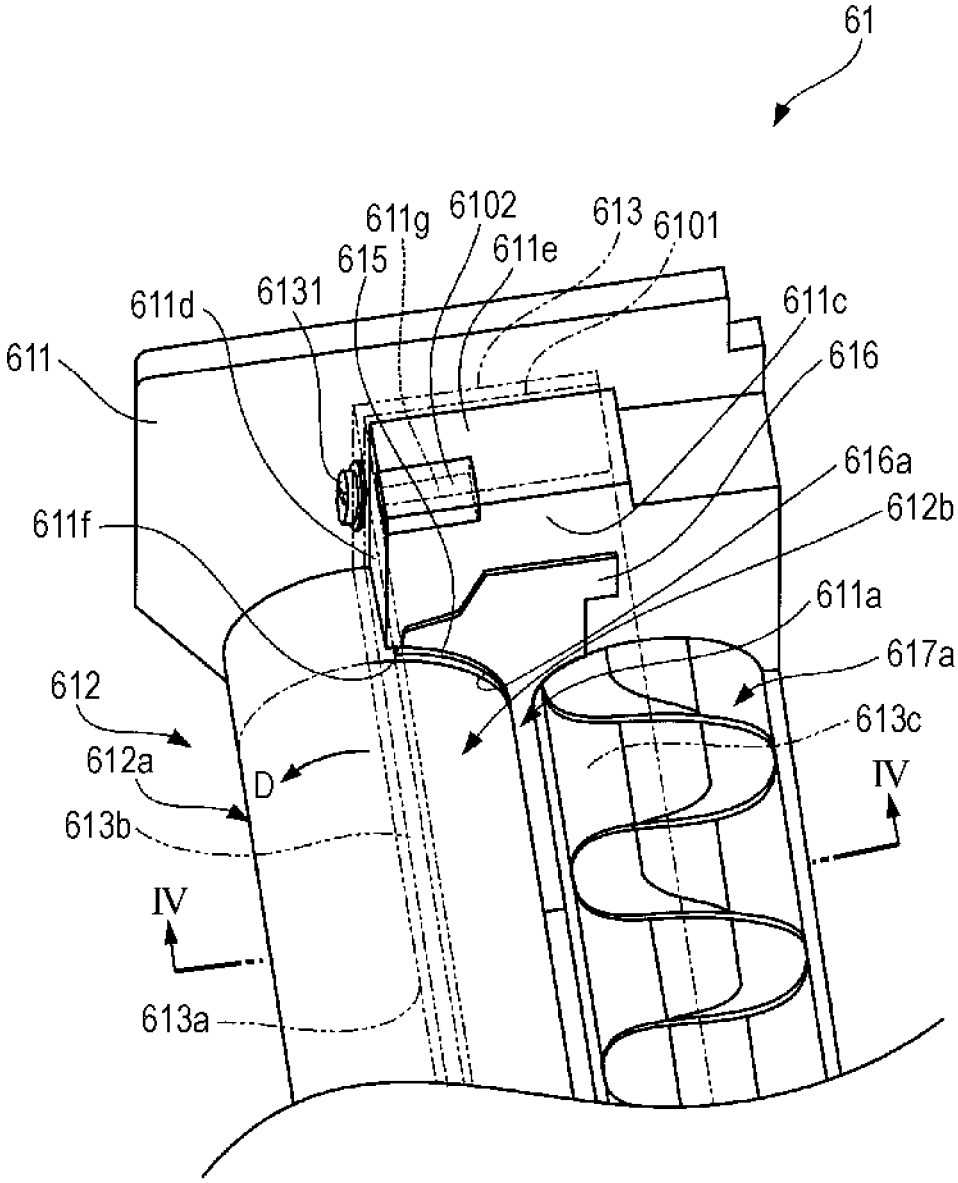
FIG. 2 is a perspective view of an end of a developing unit.
Figure 3:
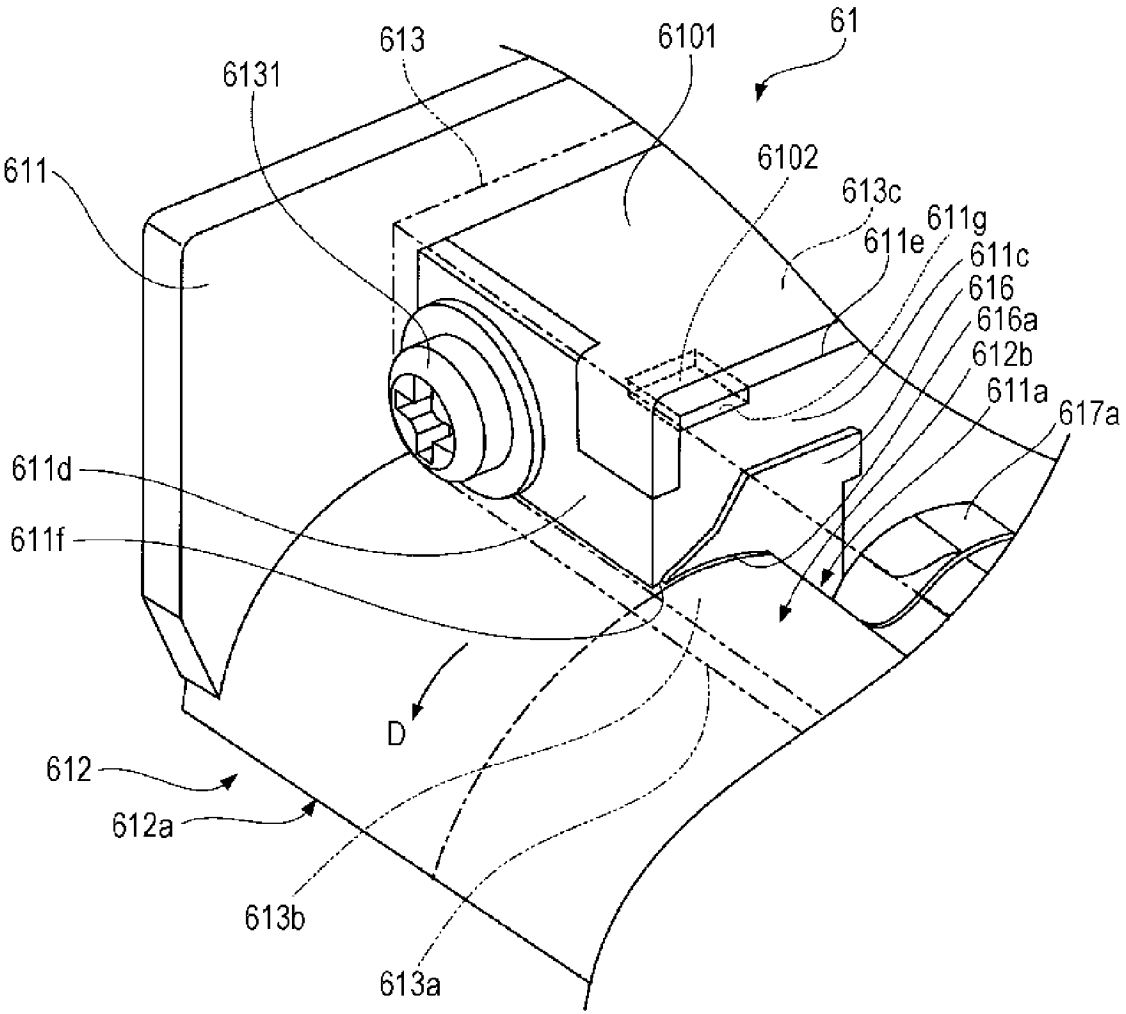
FIG. 3 is a perspective view of the end illustrated in FIG. 2, as viewed at an angle different from that of FIG. 2.
Figure 4:
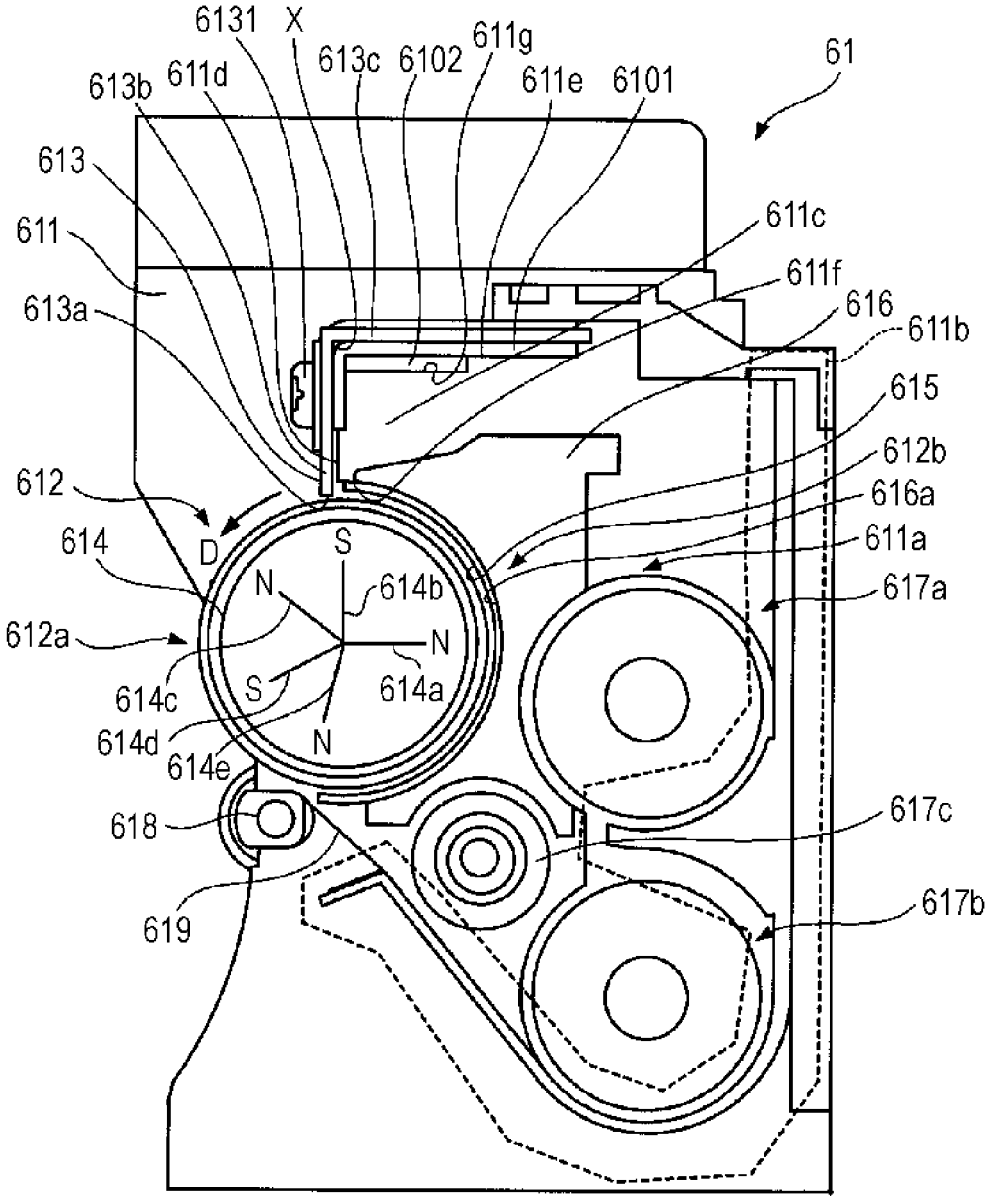
FIG. 4 is a cross-sectional view of the end of the developing unit, taken along line IV-IV of FIG. 2.

FIG. 2 is a perspective view of an end of the developing unit 61. FIG. 3 is a perspective view of the end of FIG. 1, as viewed at an angle different from that of FIG. 2. FIG. 4 is a cross-sectional view of the end of the developing unit 61, taken along line IV-IV of FIG. 2.

As illustrated in FIGS. 2 to 4, the developing unit 61 includes a housing 611, a developing roller 612, a layer-thickness regulation blade 613, a magnet roller 614 (see FIG. 4), magnet rubbers 615, magnetic plates 616, side seals 6101, and magnets 6102.

The perspective view of FIG. 2 illustrates the developing unit 61, as viewed through the layer-thickness regulation blade 613 and the side seal 6101. Further, the perspective view of FIG. 3 illustrates the developing unit 61 through the layer-thickness regulation blade 613.

The developing roller 612 is a cylindrical roller that opposes the photoconductor 51 (see FIG. 1) on which an electrostatic latent image is formed and that develops the electrostatic latent image on the photoconductor 51 by transporting developer while rotating in the direction of arrow D. The developing roller 612 corresponds to an example of a developer transport body of the present invention.

The housing 611 is molded from resin and holds the developing roller 612. The housing 611 defines an exposed portion 612*a* exposed outside on a photoconductor 51 side of the developing roller 612, and an unexposed portion 612*b*. The housing 611 includes, on the unexposed portion 612*b* side of the developing roller 612, a storage portion 611*a* that stores developer such that the developer is in contact with the developing roller 612. The housing 611 also includes a wall 611*b* (see FIG. 4) having a sectional shape shown by a broken line in FIG. 4 and extending in the rotation axis direction of the developing roller 612. The storage portion 611*a* is defined by the wall 611*b*, and is provided between the wall 611*b* and the developing roller 612. The developer in the storage portion 611*a* is agitated by three augers 617*a*, 617*b*, and 617*c* (see FIG. 4) while being transported back and forth in the rotation axis direction of the developing roller 612. This transportation reduces variations in amount of developer in the rotation axis direction. Further, both ends of the housing 611 on the developing roller 612 side in the rotation axis direction of the developing roller 612 include first faces 611*c*, second faces 611*d*, third faces 611*e*, and fourth faces 611*f*. The first faces 611*c* face from both ends toward the center in the rotation axis direction so as to define both ends of the storage portion 611*a* in the rotation axis direction. The second faces 611*d* extend in a direction intersecting the surface of the developing roller 612 and face toward the exposed portion 612*a* at a boundary where the surface of the developing roller 612 shifts from the unexposed portion 612*b* to the exposed portion 612*a* during rotation in the direction of arrow D. The third faces 611*e* extend from the second faces 611*d* toward the unexposed portion 612*b* and face toward a side opposite the developing roller 612. The fourth faces 611*f* are curved in an arc shape along the surface of the unexposed portion 612*b* of the developing roller 612. Recesses 611*g* are provided at positions where the first faces 611*c*, the second faces 611*d*, and the third faces 611*e* meet, and the magnets 6102 are embedded in the recesses 611*g*. The housing 611 corresponds to an example of a housing of the present invention. The exposed portion 612*a* corresponds to an example of an exposed portion of the present invention, the unexposed portion 612*b* corresponds to an example of an unexposed portion of the invention, and the storage portion 611*a* corresponds to an example of a storage portion of the invention. The first faces 611*c* correspond to examples of first faces of the invention, the second faces 611*d* correspond to an example of a second face of the invention, and the third faces 611*e* correspond to an example of a third face of the invention.

The layer-thickness regulation blade 613 is a metallic member that defines the storage portion 611*a* with the housing 611 and that regulates the thickness of a layer of developer transported on the exposed portion 612*a* by the rotation of the developing roller 612. The layer-thickness regulation blade 613 corresponds to an example of a layer-thickness regulation member of the present invention. The layer-thickness regulation blade 613 is detachably fixed to the second faces 611*d* with screws 6131 so that unwanted substances, such as paper dust and aggregated toner, caught between the layer-thickness regulation blade 613 and the developing roller 612 are removed. When the layer-thickness regulation blade 613 is detachably fixed to the second faces 611*d* with the screws 6131, for example, the image forming apparatus 1 may be easily disassembled for resource recovery at the time of disposal. The layer-thickness regulation blade 613 includes one side 613*a* that extends in the rotation axis direction of the developing roller 612 and that is located close to the surface of the developing roller 612 at a boundary where the surface of the developing roller 612 shifts from the unexposed portion 612*b* to the exposed portion 612*a* during rotation in the direction of arrow D. The layer-thickness regulation blade 613 regulates the thickness of a layer of developer transported from a gap between the developing roller 612 and the layer-thickness regulation blade 613 toward the exposed portion 612*a*. Further, the layer-thickness regulation blade 613 includes a first portion 613*b* (see FIG. 4) shaped like a flat plate extending from the side 613*a* in a direction intersecting the surface of the developing roller 612, and a second portion 613*c* (see FIG. 4) shaped like a flat plate extending from the first portion 613*b* toward the unexposed portion 612*b*. The first portion 613*b* and the second portion 613*c* of the layer-thickness regulation blade 613 are joined by welding such that the layer-thickness regulation blade 613 has an L-shaped cross section, as illustrated in FIG. 4. Since the layer-thickness regulation blade 613 is fixed to the second faces 611*d* with the screws 6131, as described above, the second faces 611*d* face the first portion 613*b* on the unexposed portion 612*b* side and on the outer side of the storage portion 611*a*, and the third faces 611*e* face the second portion 613*c* on the unexposed portion 612*b* side and on the outer side of the storage portion 611*a*. The first portion 613*b* of the layer-thickness regulation blade 613 defines a front part of the storage portion 611*a* in the direction of arrow D. That is, the first portion 613*b* defines the storage portion 611*a* on the forward side in the direction of transportation of developer to the exposed portion 612*a* with the rotation of the developing roller 612. Further, the second portion 613*c* of the layer-thickness regulation blade 613 defines an upper part of the storage portion 611*a* in FIG. 4. In the layer-thickness regulation blade 613, the gap between the side 613*a* and the surface of the developing roller 612 is set within the range of 0.5 to 0.8 mm such that a developer layer of a desired thickness is formed on the developing roller 612. The side 613*a* of the layer-thickness regulation blade 613 corresponds to an example of one side of the invention, the first portion 613*b* corresponds to an example of a first portion of the invention, and the second portion 613*c* corresponds to an example of a second portion of the invention.

The magnet roller 614 in the developing roller 612 illustrated in FIG. 4 is a magnet including magnetic poles extending in the rotation axis direction. That is, a first magnetic pole 614*a* is a north pole pointing toward the storage portion 611*a*. The first magnetic pole 614*a* serves to attract the developer in the storage portion 611*a* onto the developing roller 612. A second magnetic pole 614*b* is a south pole located downstream of the first magnetic pole 614*a* and upstream of the exposed portion 612*a* in the rotating direction of the developing roller 612. The second magnetic pole 614*b* serves to apply transport force to the developer passing through the gap between the developing roller 612 and the layer-thickness regulation blade 613. A third magnetic pole 614*c* is a north pole, and serves to transport the developer held on the developing roller 612 after the thickness of the developer layer is regulated. A fourth magnetic pole 614*d* is a south pole opposing the photoconductor 51 (see FIG. 1). The fourth magnetic pole 614*d* serves to attract carriers in the developer, which develops the electrostatic latent image on the photoconductor 51, onto the developing roller 612. A fifth magnetic pole 614*e* is the same north pole as the first magnetic pole 614*a*, and serves to separate the developer from the developing roller 612.

The magnet rubbers 615 are plate-shaped flexible magnets. The magnet rubbers 615 are held by the fourth faces 611*f* of the housing 611 that are curved in an arc shape along the surface of the unexposed portion 612*b* of the developing roller 612 at both ends of the developing roller 612 in the rotation axis reaction. The magnet rubbers 615 are curved in an arc shape in the rotating direction of the developing roller 612 along the surface of the developing roller 612 and are located at a distance from the developing roller 612. The magnet rubbers 615 form naps of developer, and close the gaps between the magnet rubbers 615 and the magnet roller 614 by the naps of developer, that is, the magnet rubbers 615 serve to prevent the developer from leaking from the gaps in the rotation axis direction.

The magnetic plates 616 are held on the first faces 611*c* of the housing 611. The first faces 611*c* face from both ends toward the center in the rotation axis direction, and define both ends of the storage portion 611*a* in the rotation axis direction. The magnetic plates 616 have sides 616*a* extending in the rotating direction of the developing roller 612 and located close to the developing roller 612 at boundaries between both ends of the developing roller 612 (portions provided close to the fourth faces 611*f* so as to hold the magnet rubbers 615) and a center portion of the developing roller 612 (a portion that faces the storage portion 611*a* such as to be in contact with the developer in the storage portion 611*a* and that defines the storage portion 611*a*). Naps of developer are formed between the sides 616*a* of the magnetic plates 616 and the developing roller 612. The magnetic plates 616 also prevent, by the naps of developer, the developer from leaking through gaps between the developing roller 612 and the sides 616*a* and gaps between the developing roller 612 and the fourth faces 611*f* holding the magnet rubbers 615.

As described above with reference to FIG. 1, the developing device 60 of the exemplary embodiment is a rotary developing device that rotates in the direction of arrow E (see FIG. 1). For this reason, the developer in the storage portion 611*a* moves in the storage portion 611*a* with the rotation of the developing device 60. Since the developer moves in the storage portion 611*a* in this way, it is expected that the developer will be sufficiently prevented from leaking in the rotation axis direction through between the layer-thickness regulation blade 613 and the second faces 611*d* and the third faces 611*e* of the housing 611.

In the exemplary embodiment, the side seals 6101 are provided to prevent leakage of the developer from between the layer-thickness regulation blade 613 and the second faces 611*d* and the third faces 611*e* of the housing 611. The side seals 6101 are clamped in the gaps between the layer-thickness regulation blade 613 and the second faces 611*d* and the third faces 611*e* of the housing 611 so as to close the gaps. The side seals 6101 are formed of a material having an elasticity higher than that of the housing 611, for example, urethane. Further, the side seals 6101 are stuck on the second faces 611*d* and the third faces 611*e* of the housing 611. The side seals 6101 serve to prevent the developer from leaking in the rotation axis direction from between the layer-thickness regulation blade 613 and the second faces 611*d* and the third faces 611*e* of the housing 611. The side seals 6101 correspond to an example of a closing member of the present invention.

As described above, the layer-thickness regulation blade 613 is detachably fixed to the second faces 611*d* with the screws 6131. Further, the layer-thickness regulation blade 613 is a member of L-shaped cross section that is formed by bonding the flat first portion 613*b* and the flat second portion 613*c* by welding. For this reason, small gaps X (see FIG. 4) are easily formed between a boundary between the first portion 613*b* and the second portion 613*c* of the layer-thickness regulation blade 613 and portions of the side seals 6101 opposing the boundary. It is also expected to prevent leakage of the developer from the small gaps X. Although this leakage prevention is also expected when the developing device is not a rotary developing device, unlike the exemplary embodiment, it is emphasized more when the rotary developing device is adopted.

In the exemplary embodiment, the magnets 6102 are provided to prevent leakage of the developer from the small gaps X. As described above, the recesses 611*g* are provided at the positions where the first faces 611*c*, the second faces 611*d*, and the third faces 611*e* meet. The magnets 6102 oppose the boundary between the first portion 613*b* and the second portion 613*c* of the layer-thickness regulation blade 613, and are embedded in the recesses 611*g*. That is, the magnets 6102 are provided at positions between the second faces 611*d* and the third faces 611*e* and shifted toward the storage portion 611*a*. The magnets 6102 form naps of developer to close the small gaps X, and prevent the developer from leaking in the rotation axis direction from the small gaps X. The magnets 6102 correspond to an example of a magnet opposing a boundary between the first portion and the second portion of the layer-thickness regulation member and provided between the second face and the third face of the housing.

In addition, the developing unit 61 also includes a seal roller 618 (see FIG. 4) and a metallic plate 619 (see FIG. 4) provided below the developing roller 612. The metallic plate 619 extends in contact with the seal roller 618. The seal roller 618 and the metallic plate 619 prevent dropping of the developer held on the surface of the developing roller 612 and transported from the exposed portion 612*a* to the unexposed portion 612*b*.

In the above-described embodiment, the magnets of the present invention oppose the boundary between the first portion 613*b* and the second portion 613*c* of the layer-thickness regulation blade 613 and are provided at the positions where the first faces 611*c*, the second faces 611*d*, and the third faces 611*e* of the housing 611 meet. The magnets of the invention are not limited thereto, and for example, may be provided at positions opposing the boundary between the first portion 613*b* and the second portion 613*c* of the layer-thickness regulation blade 613 and apart from the storage portion 611*a* between the second faces 611*d* and the third faces 611*e* of the housing 611.

While the rotary developing device is given as an example of the developing device of the invention, the developing device of the invention is not limited thereto. For example, the developing device may perform development with only one developing unit that does not move from a position opposing the image carrier.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a cylindrical developer transport body that opposes an image carrier on which an electrostatic latent image is formed and that transports developer while rotating to develop the electrostatic latent image;

a housing that holds the developer transport body and that defines an exposed portion exposed outside on a side of the developer transport body close to the image carrier and an unexposed portion, the housing including, on a side of the unexposed portion, a storage portion that stores the developer such that the developer is in contact with the developer transport body; and a layer-thickness regulation member that defines the storage portion and regulates a layer thickness of the developer transported to the exposed portion by rotation of the developer transport body, the layer-thickness regulation member including one side extending in a rotation axis direction of the developer transport body and provided close to a surface of the developer transport body at a boundary where the surface of the developer transport body shifts from the unexposed portion to the exposed portion during rotation, a first portion extending from the side in a direction intersecting the surface, and a second portion extending from the first portion toward the unexposed portion, wherein the housing includes first faces that face from both ends in the rotation axis direction of the developer transport body toward the center in the rotation axis direction on the side of the unexposed portion and that define both ends of the storage portion in the rotation axis direction, a second face that faces the first portion of the layer-thickness regulation member on the side of the unexposed portion and on an outer side of the storage portion, and a third face that faces the second portion of the layer-thickness regulation member on the side of the unexposed portion and on the outer side of the storage portion, and wherein the developing device further includes a closing member that closes a gap between the layer-thickness regulation member and the second face and the third face of the housing, and a magnet that opposes a boundary between the first portion and the second portion of the layer-thickness regulation member and is provided between the second face and the third face of the housing.

2. The developing device according to claim 1, wherein the layer-thickness regulation member is detachably fixed to the housing.

3. An image forming apparatus comprising:

an image carrier on which an electrostatic latent image is formed and developed into a developed image, the image carrier carrying the developed image;

a developing unit that develops the electrostatic latent image formed on the image carrier;

a transfer unit that transfers the developed image on the image carrier onto a recording medium; and a fixing unit that fixes the transferred developed image on the recording medium, wherein the developing unit includes a cylindrical developer transport body that opposes the image carrier and that transports developer while rotating to develop the electrostatic latent image formed on the image carrier, a housing that holds the developer transport body and that defines an exposed portion exposed outside on a side of the developer transport body close to the image carrier and an unexposed portion, the housing including, on a side of the unexposed portion, a storage portion that stores the developer such that the developer is in contact with the developer transport body, and a layer-thickness regulation member that defines the storage portion and regulates a layer thickness of the developer transported to the exposed portion by rotation of the developer transport body, the layer-thickness regulation member including one side extending in a rotation axis direction of the developer transport body and provided close to a surface of the developer transport body at a boundary where the surface of the developer transport body shifts from the unexposed portion to the exposed portion during rotation, a first portion extending from the side in a direction intersecting the surface, and a second portion extending from the first portion toward the unexposed portion, wherein the housing includes first faces that face from both ends in the rotation axis direction of the developer transport body toward the center in the rotation axis direction on the side of the unexposed portion and that define both ends of the storage portion in the rotation axis direction, a second face that faces the first portion of the layer-thickness regulation member on the side of the unexposed portion and on an outer side of the storage portion, and a third face that faces the second portion of the layer-thickness regulation member on the side of the unexposed portion and on the outer side of the storage portion, and wherein the developing unit further includes a closing member that closes a gap between the layer-thickness regulation member and the second face and the third face of the housing, and a magnet that opposes a boundary between the first portion and the second portion of the layer-thickness regulation member and is provided between the second face and the third face of the housing.

4. The image forming apparatus according to claim 3, wherein the layer-thickness regulation member is detachably fixed to the housing.

* * * * *